US006675534B2

(12) United States Patent
Marocco

(10) Patent No.: US 6,675,534 B2
(45) Date of Patent: Jan. 13, 2004

(54) SHUTTER WITH PUSH/PULL CONTROL FOR SHUTTER BLADES

(75) Inventor: Norbert Marocco, Woodbridge (CA)

(73) Assignee: Shade-O-Matic Limited, Ontario (CA)

( * ) Notice: Subject to any disclaimer, the term of this patent is extended or adjusted under 35 U.S.C. 154(b) by 0 days.

(21) Appl. No.: 10/052,740

(22) Filed: Jan. 18, 2002

(65) Prior Publication Data

US 2003/0136053 A1 Jul. 24, 2003

(51) Int. Cl.[7] ..... E06B 7/086
(52) U.S. Cl. ..... 49/86.1; 49/87.1; 49/74.1
(58) Field of Search ..... 49/87.1, 74.1, 49/86.1, 90.1, 79.1, 80.1; 454/309, 313, 314; 52/473

(56) References Cited

U.S. PATENT DOCUMENTS 145,481 A * 12/1873 Beach et al. ..... 49/87.1
1,482,435 A * 2/1924 Jenkins ..... 49/86.1
2,030,234 A * 2/1936 Villalobos ..... 49/77.1
2,556,695 A * 6/1951 Jansen ..... 49/81.1
2,834,280 A * 5/1958 Feldman et al. ..... 49/90.1
2,874,771 A * 2/1959 Muhr ..... 49/82.1 X
3,156,956 A * 11/1964 Jacobson ..... 49/87.1
4,373,568 A * 2/1983 Lancellotti ..... 49/90.1 X

* cited by examiner

*Primary Examiner*—Hugh B. Thompson
(74) *Attorney, Agent, or Firm*—Ohlandt, Greeley, Ruggiero & Perle, L.L.P.

(57) ABSTRACT

A shutter having a rectangular frame and shutter blades mounted parallel to one another across said frame, the blades being rotatable between open and closed positions, and having a control recess formed in one of the side frames, control bodies within the control recess connected to respective shutter blades, for rotating respective said blades, links connecting the control bodies, and, fastening clamps on the control bodies for adjustably fastening respective said control bodies to respective links, so as to align all of the control bodies into predetermined rotational positions, and in which the links communicate rotational movement of any one blade through the control bodies to all the blades.

16 Claims, 8 Drawing Sheets

SHUTTER WITH PUSH/PULL CONTROL FOR SHUTTER BLADES

FIELD OF THE INVENTION

The invention relates to shutters having a frame, and shutter blades extending from side to side of the frame. The shutter blades are rotatable between open and closed positions in particular the invention relates to such a shutter in which all shutter blades are linked together for movement in unison.

BACKGROUND OF THE INVENTION

Shutters are well known for providing an attractive and decorative means for closing windows and doors. Usually such shutters are as far as possible similar in appearance to old style wooden shutters such as have been in use for very many years especially in Europe. Such old style shutters had a shutter frame and shutter blades extending across the frame, the blades being rotatable to open or close the shutter. Usually there was a pull rod attached to each of the shutter blades so that they all moved in unison.

Such shutters were also usually hinged on one side of a window opening so that they could be swung open, or closed if desired.

Modern style shutters usually use shutter frames and shutter blades made of plastic materials, for greater durability. Various forms of links, and mechanisms have been proposed for connecting the shutter blades so that they all rotate in unison, and can be set and held in any desired angular position of rotation.

One particularly successful form of such shutter blade control is shown in U.S. Pat. No. 5,469,658 dated Nov. 28, 1995, title Louvre Shutter Device with Variable Slats, inventors M. Diagianni and Norbert Marocco.

One of the problems addressed by this system, was the problem of making the shutter fit the window or door frame, while maintaining the shutter blades at equal spacings.

In the past the problem of fitting the shutter frame to the window or door was dealt with by simply making the shutter frame extra wide at the top and bottom, and then simply trimming off portions from one or the other to fit the space.

This produced a shutter which was off balance in appearance, the shutter frame being out of proportion in some way, after trimming.

The invention described in the above noted patent provides a system of adjustable spacing for the centres of rotation for the shutter blades. This means that the shutter frame can be made of standard width stock, and the size of the frame and the spacings of the shutter blades is varied to match the actual space defined by the window or door. In this way all the shutters at a particular location or dwelling could have a uniform pleasing appearance, since all of the frames were made of materials having matching dimensions, and therefor produced a balanced appearance. The shutter blades were controlled by a rack and pinion system which allowed the blades to be located at predetermined centres. The spacing between the centres could be varied from one shutter to another, so that a given number of blades could be fitted into a frame, which might be higher or lower than the frame of an adjacent shutter. This was of assistance in achieving the result of a balanced overall appearance.

It has been found that while this rack and pinion system was an effective solution to the problem, the assembly and adjustment of the shutter blades and the fixing of the gears to the blade axles in the correct rotational position was somewhat more time consuming than was desirable, and required some skill and training for the personnel working in that department.

Clearly, if a somewhat simpler system can be developed which achieves the same end result, and advantages, especially in the interconnection of shutter blades so that they all remain coplanar and rotate together in unison, and which can accommodate variations in the spacings of the centres of the shutter blades, without involving so much time and skill in assembly, it would have many advantages.

Another situation where shutter blades are moved in unison is in the case of shutters used for overhead windows, or in commercial establishments, such as greenhouses and the like. In these case the windows are often extended from a vertical portion through a curved portion to an overhead portion. Shutters are required to control passage of sunshine through the entire extent of such windows. Preferably all the shutters shall be connected to the same control system, so that a single adjustment control will adjust all of them simultaneously, and to the same extent. This becomes especially difficult in the case of shutters arranged around a curved window.

BRIEF SUMMARY OF THE INVENTION

With a view to achieving the foregoing features and advantages the invention provides a shutter having side frames and end frames and a plurality of shutter blades mounted parallel to each other and extending from side frame to side frame, and being rotatable between open and closed positions and having a control recess in one of said side frames, control bodies connected to respective said blades and located in said cortrol recess, said control, bodies being rotatable within said recess to rotate respective said blades, and links connecting said control bodies, and fastening devices on said control bodies for adjustably fastening respective said control bodies to respective said links, whereby to align all said control bodies into predetermined rotational positions, said links communicating rotational movement of any one said blade through said control bodies to all said blades so as to procure simultaneous rotation of all said blades into a desired rotational position.

The invention further provides a shutter of the type described and wherein the control bodies are non-rotatably keyed to respective said blades, and wherein said fastening devices are adjustable to adjust the positions of respective said control bodies relative to said links.

The invention further provides a shutter of the type described and wherein said control bodies define a rotation axis and two fastening devices spaced on opposite sides of said rotation axis and wherein the links comprise two elongated rigid members spaced to register with respective said fastening devices, and being adjustably secured thereto.

The invention further provides a shutter of the type described and wherein said blades include drive axles extending from said blades into said control recess, and defining non-rotatable keying surfaces, and wherein said control bodies defining non-rotatable keying recesses shaped to non-rotatably receive said blade axles therein.

The invention further provides a shutter of the type described and wherein said fastening devices are rotatably attached to respective said control bodies, and incorporate clamps for clamping onto respective said links.

The invention further provides a shutter of the type described and wherein respective said fastening devices comprise respective plugs rotatably received in said control bodies, and said clamps are adjustable attached to said plugs, for clamping respective said links between said plugs and said clamps.

The invention further provides a shutter of the type described. The plugs define angular surface portions and include sockets. The sockets define locking surfaces complementary to the angular surfaces on the plugs. A fastening passes through a clamp and through the plug and through a socket, securing the clamps to the plugs.

The invention further provides a shutter of the type described and wherein said control bodies define respective sleeves, said sleeves receiving respective said blade axles, and being corotatable with said blade axles.

The invention further provides a shutter of the type described and including a set up jig defining a plurality of spaced apart holes, for adjusting said control bodies relative to said links, and said holes being located to receive respective said sleeves of respective said control bodies, whereby to establish the spacing between said control bodies relative to said links.

The invention further provides a shutter of the type described and wherein said shutter is shaped and designed to fit around an arc, and wherein said links are adjustable between each blade.

The invention further provides a shutter of the type described and wherein said links comprise two elongated metal rods.

The invention further provides a shutter of the type described and wherein said links comprise flexible wire cables.

The invention further provides a shutter of the type described and wherein said links comprise, a first link portion rotatably secured to one said blade, and a second link portion rotatably secured to an adjacent said blade, and an adjustment device securing said first and second link portions together.

The various features of novelty which characterize the invention are pointed out with more particularity in the claims annexed to and forming a part of this disclosure. For a better understanding of the invention, its operating advantages and specific objects attained by its use, reference should be made to the accompanying drawings and text in which there are illustrated and described preferred embodiments of the invention.

IN THE DRAWINGS

DESCRIPTION OF A SPECIFIC EMBODIMENT

Figure 1:
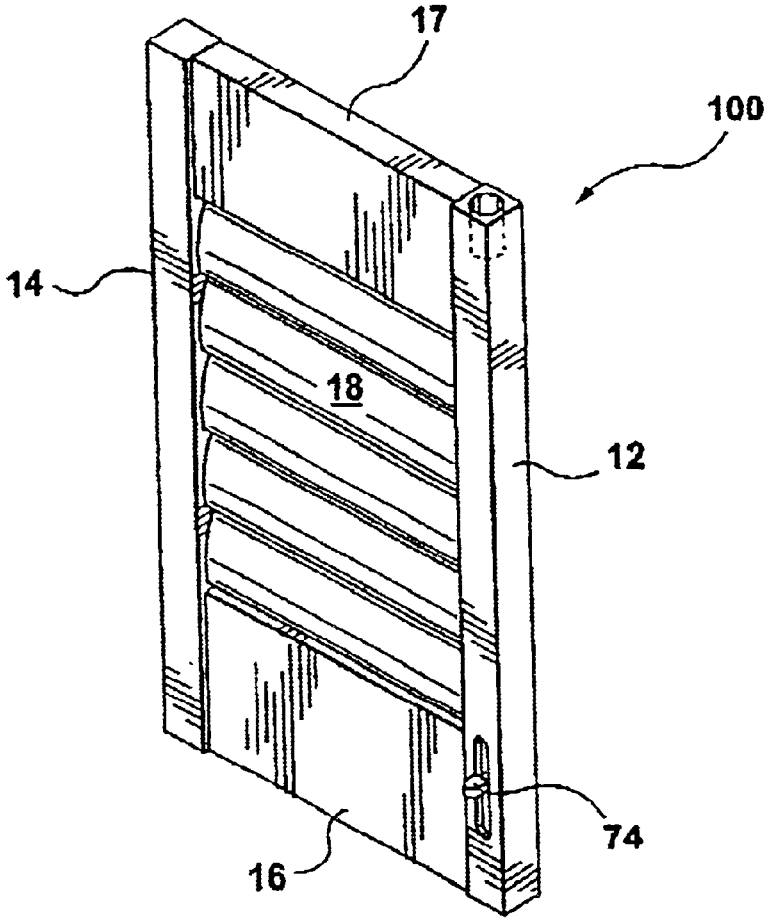
FIG. 1 is a perspective illustration of the general type of shutter to which the invention is applicable.
Figure 2A:
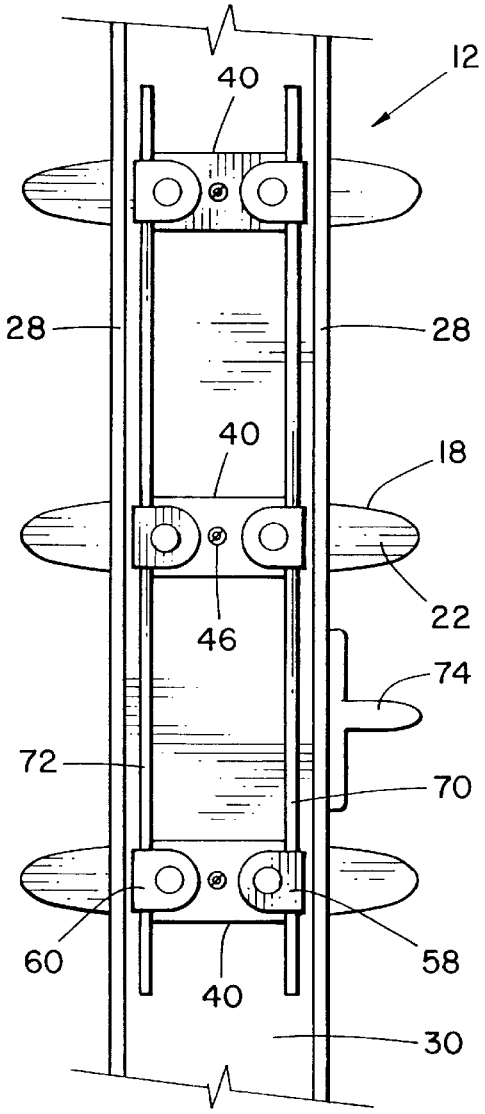
FIG. 2A is a section along the line 2—2 of FIG. 1, showing shutter blades at a first predetermined spacing.
Figure 2B:
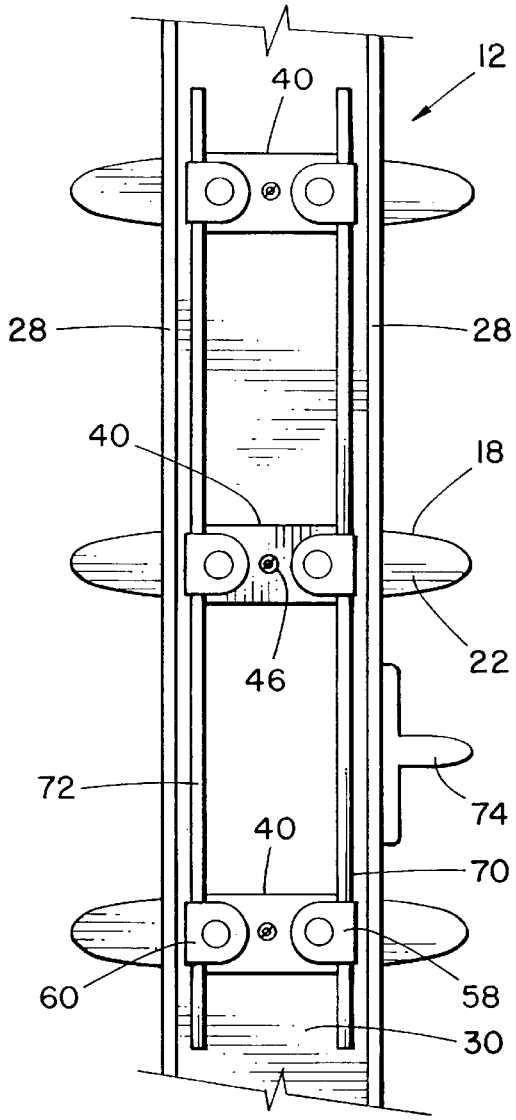
FIG. 2B is a section along the line 2—2 of FIG. 1, showing the shutter blades at a second predetermined spacing, different from FIG. 2A.

Referring to FIG. 1 it will be understood that this simply illustrates the type of shutter to which the invention relates. Such a shutter 10 has a rectangular frame with side members 12 and 14, and top and bottom members 17 and 16, respectively.

Extending between side members 12 and 14 are a series of shutter blades 18. Shutter blades 18 are pivotally mounted on integral axles described below carried in side frames 12 and 14. Shutter blades 18 are parallel to one another, and rotate between open and closed positions. Conventional shutters of this type had shutter blades made of wood. A control bar (not shown) was secured, usually to the median of each of the shutter blades, by metal staples. The control bar moved all the shutter blades together. Usually the pivots of the shutter blades were somewhat stiff and thus held the shutter blades in a preset orientation.

Such shutters are now preferably made of plastic material for longer life and trouble free operation. In addition customers prefer that the control for the shutter blades shall be located to one side of the shutter frame, and preferably concealed altogether.

Such controls for such shutter blades 18 are shown in more detail in FIGS. 2 to 7, for the sake of illustrating the invention.

Before explaining such controls it should be understood that each of the shutter blades 18 is hollow and formed of extruded plastic, in a generally flattened aerofoil shape.

Figure 6:
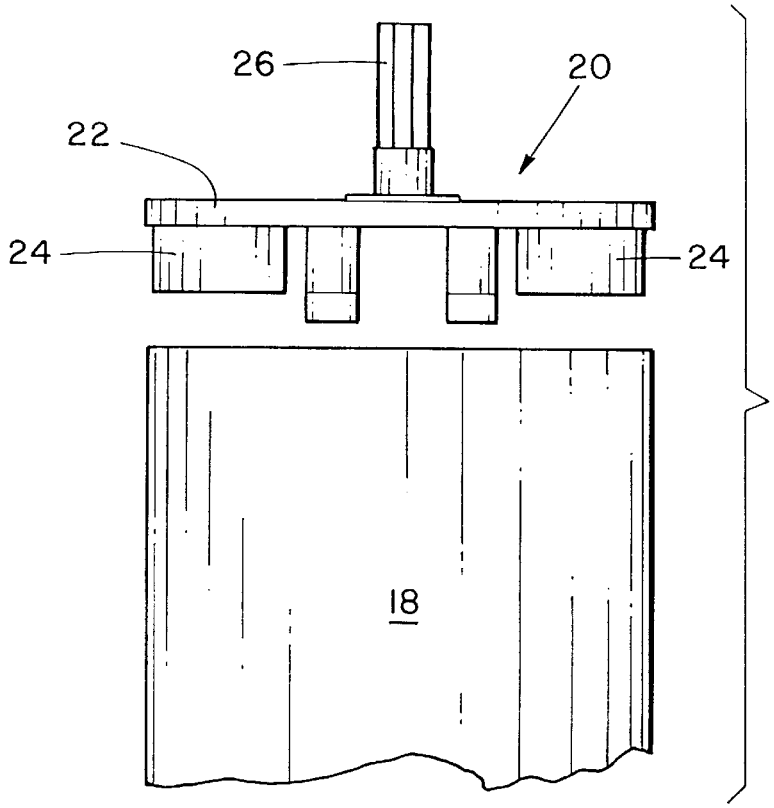
FIG. 6 is an exploded plan view of a shutter blade end assembly.

At each end of each of shutter blades 18, there is an end member 20 (FIG. 6).

End member 20 has a body 22 shaped to close off the end of each shutter blade 18. Inward plug portions 24 are formed on member 20 and fit into the open ends of the shutter blades 18. They may be secured by suitable adhesive.

An axle 26 extends outward from each body 22, for reception in suitable openings in the side 12 and 14. Each axle 26 defines a hexagonal exterior in section for reasons to be described.

Each of side frames 12 and 14 is of hollow extruded construction (FIG. 3), having side walls 28, an inner facing wall 30 and an outer frame wall 32.

Inner facing wall 30 is formed with axle receiving openings 34 for receiving axles 26.

Outer wall 32 is formed with oversize openings 36, for reasons to be described below.

L-shaped retention flanges 38 extend beyond outer wall 32 for reasons to be described.

The system for controlling the rotational positions of the shutter blades 18, illustrated in FIGS. 2 to 7, is located within one of side frames 14 or 16, the side frame 16 being chosen in this case, solely for purpose of explanation and without limitation.

The control system has a plurality of control bodies 40, there being one such control body 40 for each of shutter blades 18, all being located within the one side frame, in this case side frame 12, for the sake of illustration.

Each of control bodies 40 as a central sleeve 42, in this case of generally hexagonal shape in section corresponding to the shape of axle 26, and dimensioned to receive an axle 26 of a shutter blade 18. Axles 26 have central bores 44 to receive fasteners, such as screws 46. In this way bodies 40 are non-rotatably secured to axles 26, so as to achieve a positive drive therebetween. Rotation of bodies 40 will thus cause rotation of the shutter blades 18.

Each body 40 has two side portions 4848, defining through openings 50—50. Each body 40 has attached thereto two rotary plugs 52 and 54, respectively received in respective openings 50, and being rotatable therein.

Semi-cylindrical grooves 56 are formed in upper portions of plugs 52 and 54.

Clamp heads 58 and 60 are secured to respective plugs 52 and 54, by screws 62.

Heads 58 and 60 have semi-cylindrical grooves 64 complementary to and registering with grooves 56.

Screws 62 pass completely through plugs 52 and 54 and are received in sockets 66.

Sockets 66, for the sake of convenience in assembly, and operation, define internal locking formations, typically being hexagonal surfaces, and plugs 52 and 54 define reduced size end portions 68 defining complementary locking surfaces, typically hexagonal surfaces. In this way the sockets 66 and plugs 52 and 54 are locked together for rotation in unison, while leaving plugs 52 and 54 free to rotate in openings 50 in side portions 48 of bodies.

Sockets 66 are dimensioned so as to leave a clearance 66A between themselves and the underside of side portions 48. In this way the screws can be tightened up clamping the heads 58 and 60 to respective plugs 52 and 54. The control bodies 40 are linked together by pairs of control rods 70 and 72.

Rods 70–72 are clamped in respective grooves 56 between heads 58–60, and plugs 52 and 54, of respective control bodies 40, thereby linking all of the control bodies 40 together for rotational movement in unison.

Rotation of any one of the shutter blades 18 will cause rotation of its control body 40. This in turn will cause one of rods 70 or 72 to move axially in one direction, and simultaneously cause the other of rods 70 or 72 to move axially in the opposite direction. This will achieve a "push-pull" action on each of bodies 40, and cause rotation of all shutter blades 18 in unison.

The control rods 70–72 may be connected (by means not shown) to an exterior hand control 74. In this case control 74 is shown as a slide mounted on the frame 16, but any other form of hand operation may be suitable.

The shutter blades 18 may be held in position, by any suitable form of friction means. For example some for of friction means could be incorporated in the manual control 74 so that the blades are held against inadvertent rotation due to the action of for example the wind, but not being so tight as to prevent manual operation.

Alternatively the operation of rods 70–72 may be produced by an electric control motor 76, which will have the effect of acting as a brake on the shutter blades 18 when it is inactive. In order to provide a finished appearance a slide closure strip 78 (FIG. 3), may be slid between outer frame wall 32 and retention ribs 38, and secured, for example, by adhesive.

Figure 7:
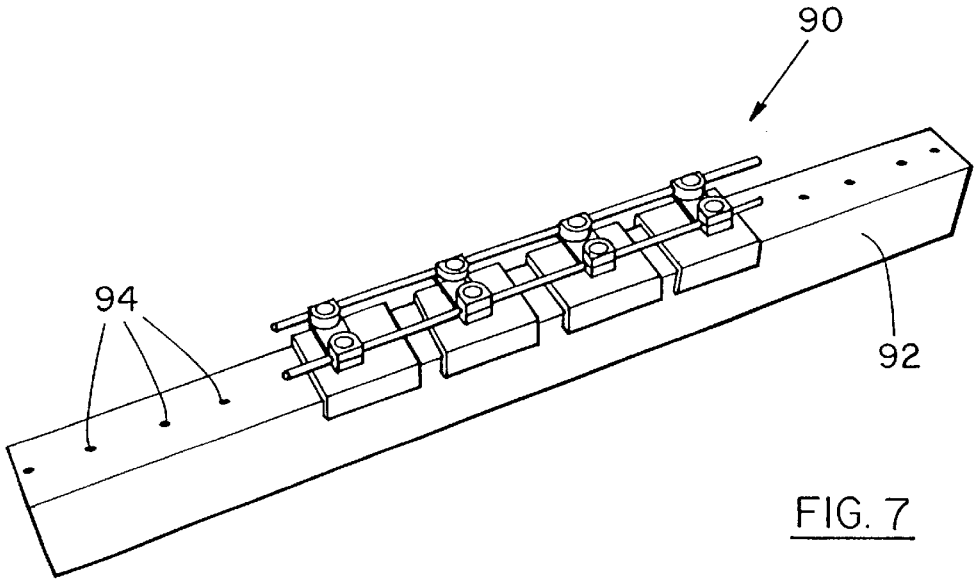
FIG. 7 is a perspective of the links, in the process of being set to a predetermined shutter blade spacing, using a special set up jig.

Assembling of the control bodies 30 in the correct spaced location on the rods 70–72, can be facilitated by the use of a simple assembly jig 90 (FIG. 7). Jig 90 consists of a channel shaped member 92, in which there are a plurality of holes 94. Holes 94 will be spaced by an automatic drill apparatus (not shown) at spacings corresponding to the spacings of openings 34 in inner wall 30. This will vary from one shutter to another, (as explained above), and the jig 90 can simply be a channel extrusion which has been drilled on the same centres as the side members of the shutter frame.

In use the control bodies are placed with their sleeves 42 on respective holes 94. The rods can then be slid into position in the grooves 56. The control bodies are all then rotated into precise parallel relation, and the screws 62 are tightened up clamping the rods 70–72 to the plugs 52–54.

Figure 3:
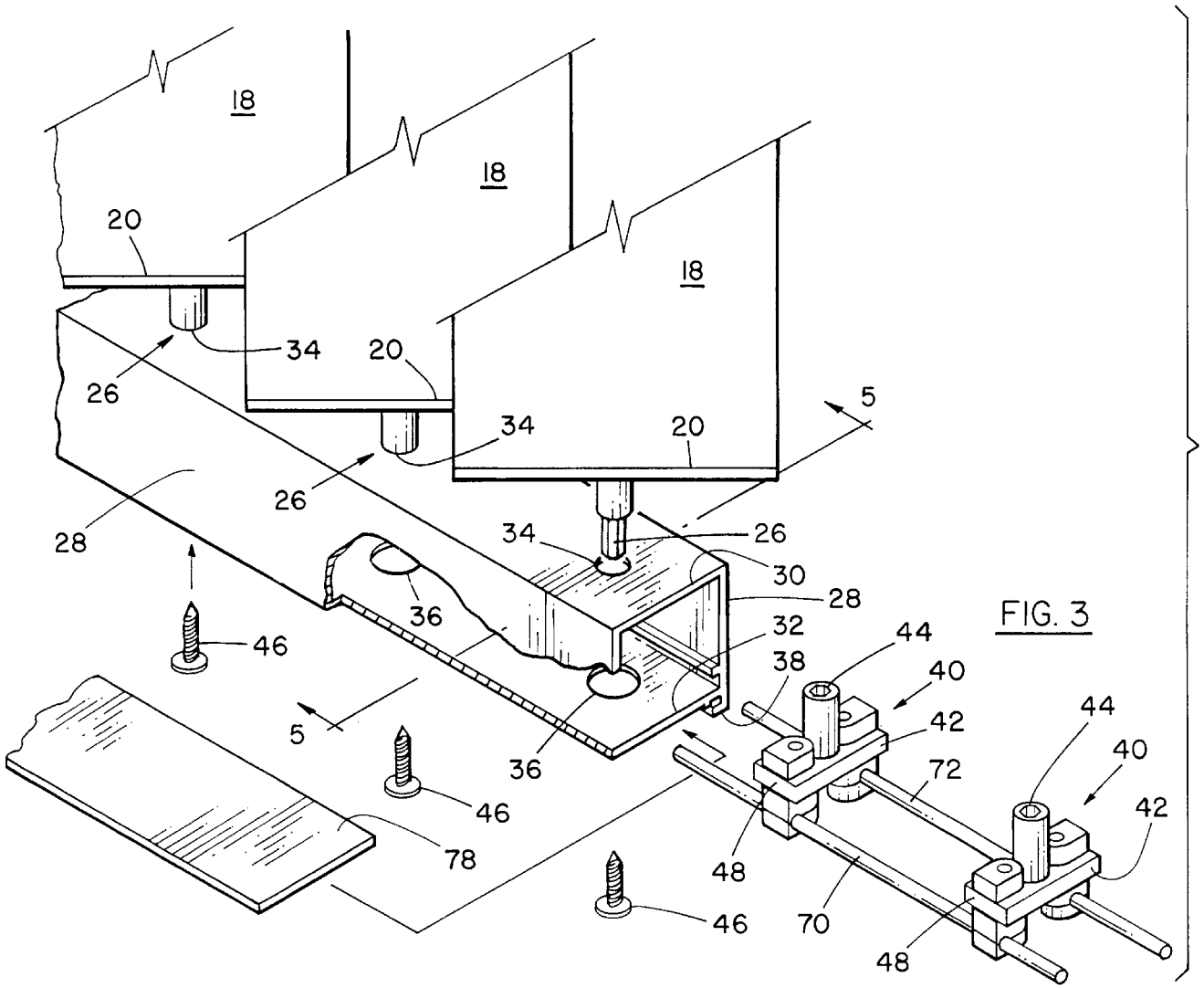
FIG. 3 is a exploded perspective illustration showing the links for interconnecting the shutter blades in the process of being assembled in the hollow side frame of a shutter.
Figure 4A:
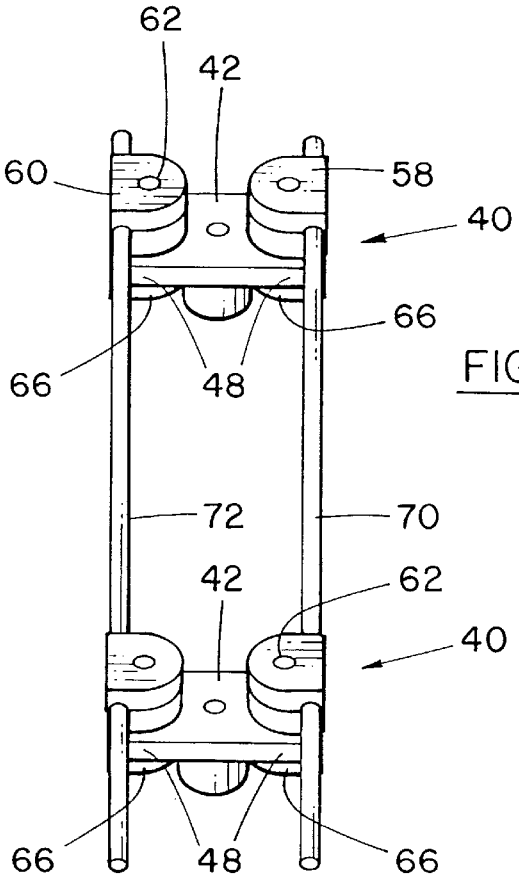
FIG. 4A is a perspective showing the links and control bodies in a first position, corresponding to the shutter blades being fully open.
Figure 4B:
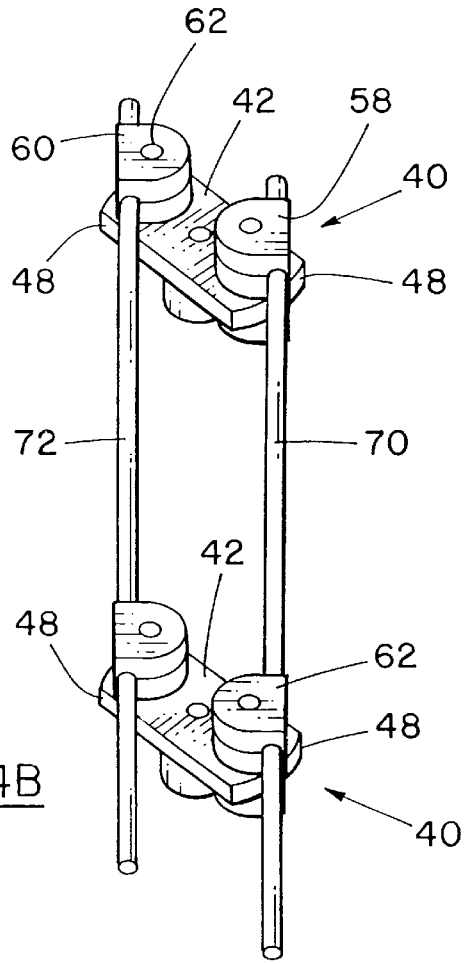
FIG. 4B is a perspective showing the links and control bodies in a second position, corresponding to the shutter blades being "partly open"
Figure 5:
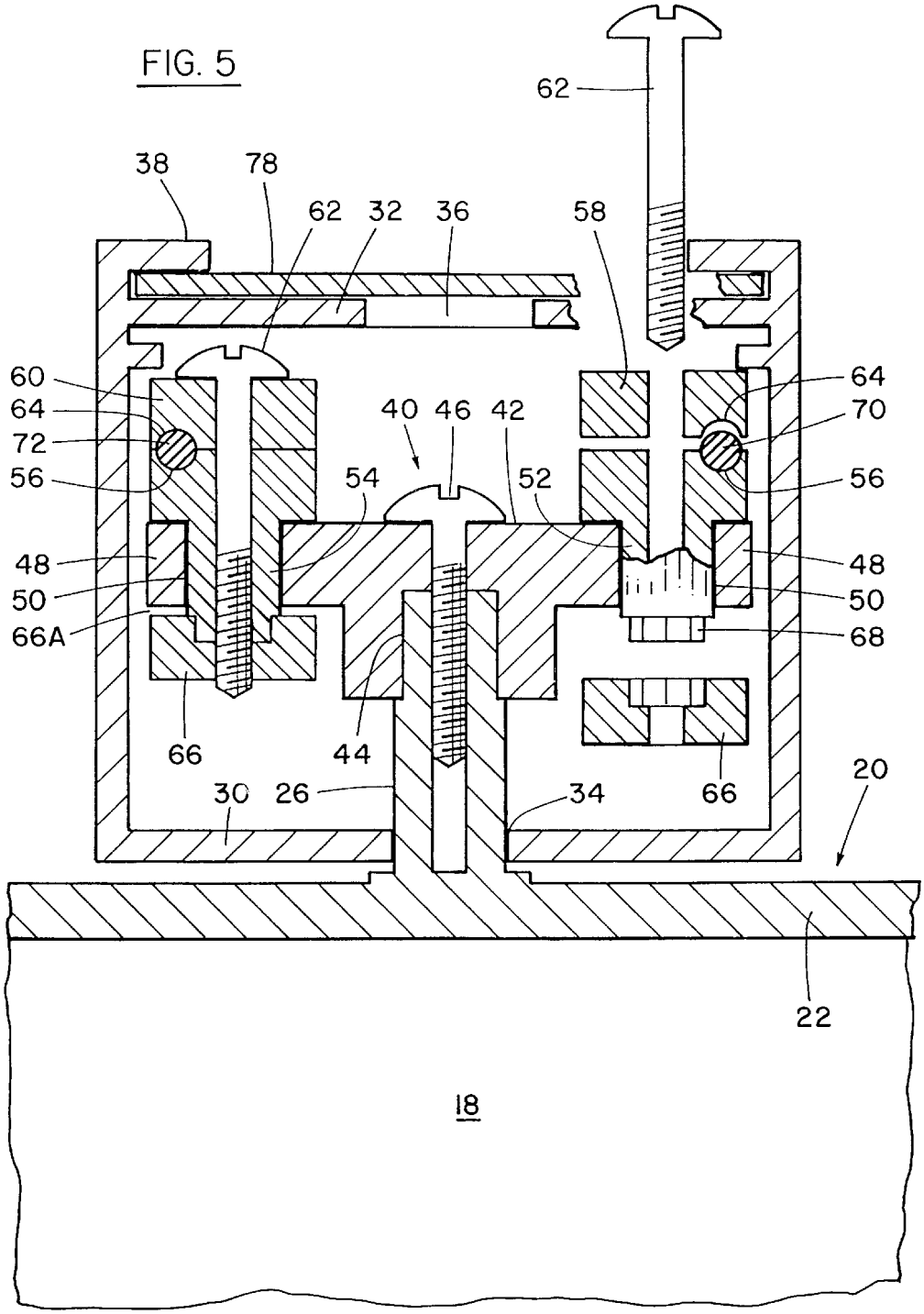
FIG. 5 is a section of a portion of one of the control bodies, along the line 5—5 of FIG. 2, showing the parts assembled.

The assembled set of control bodies and rods can then be inserted in the manner shown in FIG. 3. The blade axles are then inserted into holes 34. Screws 46 are then inserted to secure the axles 26 in the sleeves 42. Holes 36 in outer walls 32 provide access to insert such screws 46 for the purpose. Both the blade axles 26 and the sleeves 42 define interior flat surfaces making them non-rotational relative to one another and keying them together.

Closure slide 78 is then inserted as shown in FIG. 3.

The assembly of the rest of the shutter is self-evident and requires no special description.

Figure 8:
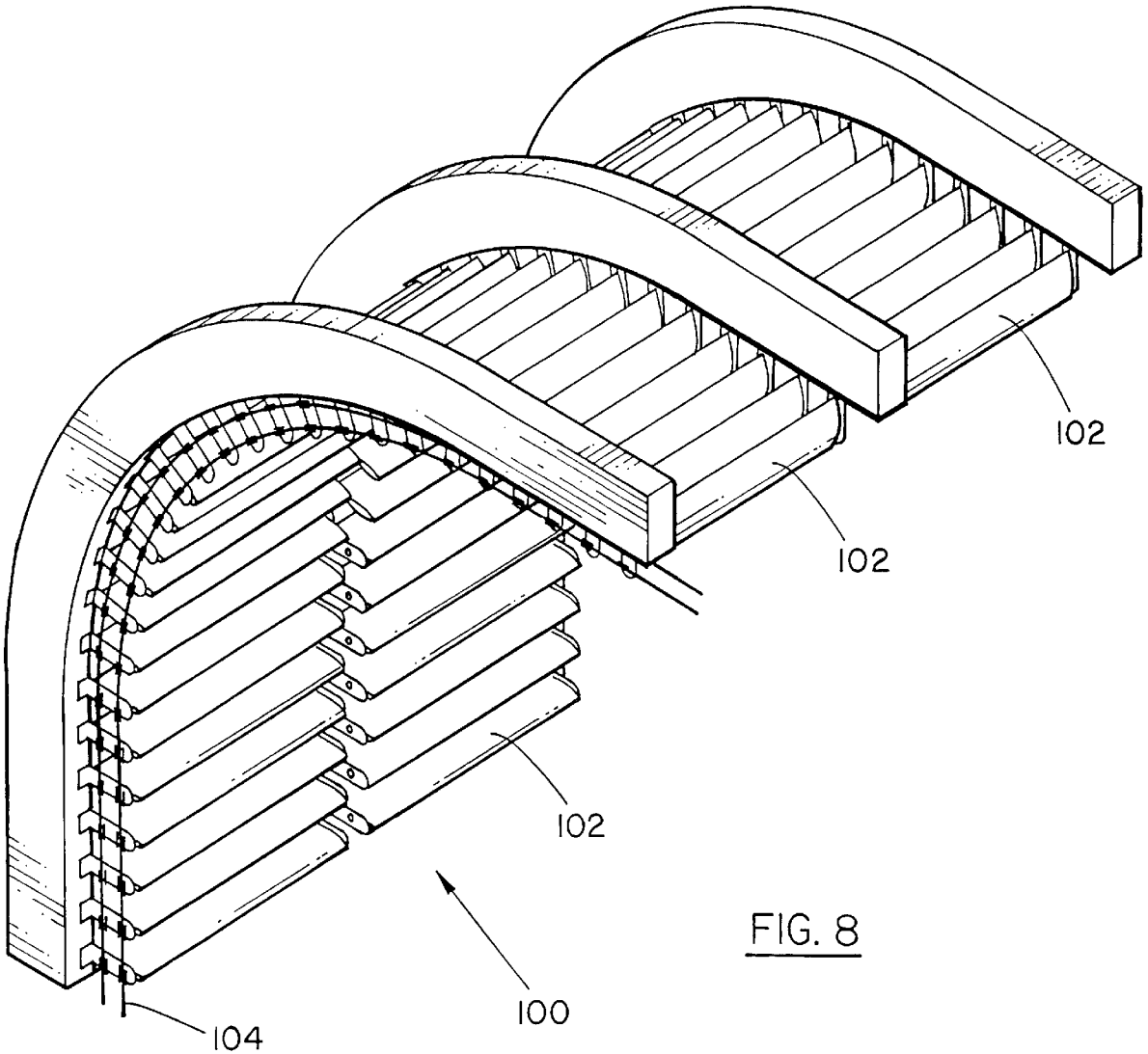
FIG. 8 is a perspective illustration of an alternate embodiment for use with an arched or curved window and skylight; and, FIG. 9 is an enlarged perspective of the connection between two shutter blades showing its method of adjustment.
Figure 9:
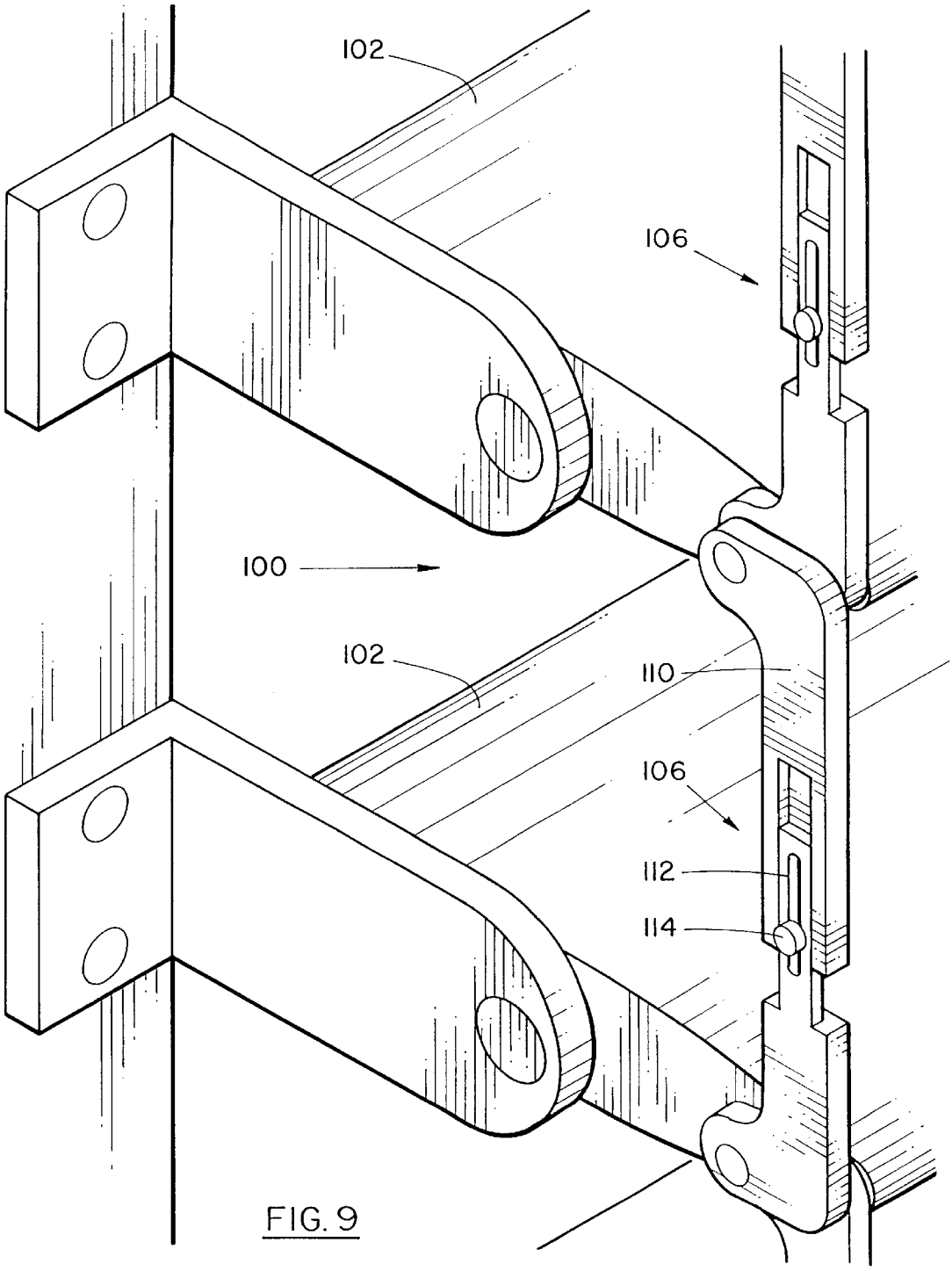

The invention can also be used for shutters extending around an arc, as shown in FIGS. 8 and 9.

FIG. 8 shows a n arch shaped shutter 100 having blades 102 linked by links 104.

The links 104 can be secured by control bodies (not shown) similar to those described above. However in a simplified form of shutter such as may be used in commercial applications, such as a greenhouse, for example, the shutter blades 102 may be linked by a series of adjustable links 106. Links 106 are made up of link portions 108 and 110. One link portion 110 is slotted as at 112 and a bolt 114 provides an adjustable means of securing the two link portions 108–110 together.

While this system is not concealed in any framework, concealment is not required when used in a commercial application such as that suggested above.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a plurality of side frames, a plurality of end frames, and a plurality of shutter blades being mounted parallel to one another across said plurality of side frames, the plurality of shutter blades being rotatable between open and closed positions, the plurality of end frames being connected to the plurality of side frames, the shutter comprising:

a control recess being formed in one of said plurality of side frames;

a plurality of control bodies being in said control recess, each of said control bodies being connected to a respective one of the plurality of shutter blades, said plurality of control bodies being located in and rotatable in said control recess to rotate the plurality of shutter blades;

a plurality of links connecting said plurality of control bodies; and a plurality of fastening devices being on said control bodies for adjustably fastening said control bodies to said plurality of links, whereby said plurality of links are adjustable in length between each of the plurality of shutter blades, and said plurality of links communicate rotational movement of any one of the plurality of shutter blades through said plurality of control bodies to all of the plurality of shutter blades so as to rotate all of the plurality of shutter blades into a desired rotational position to align all of said control bodies into predetermined rotational positions.

2. The shutter as claimed in claim 1, wherein the plurality of shutter blades each have a drive axle, said drive axle extending from the plurality of shutter blades into said control recess, and said drive axle defining a non-rotatable keying surface, and wherein said plurality of control bodies define non-rotatable keying recesses being shaped to non-rotatably receive said drive axle therein.

3. The shutter as claimed in claim 1, wherein said plurality of links comprise two elongated metal rods.

4. A shutter having a plurality of side frames, a plurality of end frames, and a plurality of shutter blades being mounted parallel to one another across said plurality of side frames, the plurality of shutter blades being rotatable between an opened and a closed position, the plurality of end frames being connected to the plurality of side frames, the shutter comprising:

a control recess being formed in one of said plurality of side frames;

a plurality of control bodies being in said control recess, each of said control bodies being connected to a respective one of the plurality of shutter blades, said plurality of control bodies being located in and rotatable in said control recess to rotate the plurality of shutter blades, said plurality of control bodies being non-rotatably keyed to the plurality of shutter blades;

a plurality of links connecting said plurality of control bodies; and a plurality of fastening devices on said plurality of control bodies, said plurality of fastening devices for adjustably fastening said plurality of control bodies to said plurality of links, whereby to align all of said plurality of control bodies into predetermined rotational positions, said plurality of links communicate rotational movement of any one of the plurality of shutter blades through said plurality of control bodies to all of the plurality of shutter blades to simultaneous rotate all of the plurality of shutter blades into a desired rotational position, and wherein said plurality of fastening devices are adjustable to adjust said predetermined rotational positions of said plurality of control bodies relative to said plurality of links.

5. A shutter having a plurality of side frames, a plurality of end frames, and a plurality of shutter blades being mounted parallel to one another across said plurality of side frames, the plurality of shutter blades being rotatable between an opened and a closed position, the plurality of end frames being connected to the plurality of side frames, the shutter comprising:

a control recess being formed in one of said plurality of side frames;

a plurality of control bodies being in said control recess, each of said control bodies being connected to a respective one of the plurality of shutter blades, said plurality of control bodies being located in and rotatable in said control recess to rotate the plurality of shutter blades;

a plurality of links connecting said plurality of control bodies; and a plurality of fastening devices on said control bodies, said plurality of fastening devices for adjustably fastening said plurality of control bodies to said plurality of links, whereby to align all of said control bodies into predetermined rotational positions, said plurality of links communicate rotational movement of any one of the plurality of shutter blades through said control bodies to all of the plurality of shutter blades for simultaneously rotating all of the plurality of shutter blades into a desired rotational position, wherein said plurality of control bodies each define a respective rotation axis, and wherein two of said plurality of fastening devices are spaced on opposite sides of said rotation axis.

6. The shutter as claimed in claim 5, wherein said plurality of links comprise two elongated rigid members being spaced to register with said plurality of fastening devices, and are adjustably secured thereto.

7. The shutter as claimed in claim 5, wherein said plurality of fastening devices are rotatably connected to said plurality of control bodies, and said plurality of fastening devices further comprise clamps for clamping to said plurality of links.

8. The shutter as claimed in claim 7, wherein said plurality of fastening devices comprise a plurality of plugs being rotatably received in said plurality of control bodies, wherein said clamps are adjustable and connected to said plurality of plugs, and wherein said clamps clamp said plurality of links between said plugs and said clamps.

9. The shutter as claimed in claim 8, wherein said plugs define angular surface portions and have sockets defining locking surfaces being complementary to said angular surface portions, and one of said plurality of fastening devices passing through said clamp, said plugs and a socket, and wherein one of said plurality of fastening devices secures said clamps to said plugs, and said plugs to said control bodies.

10. The shutter as claimed in claim 5, wherein said control bodies define sleeves for receiving a blade drive axle, and wherein said sleeves are corotatable with said blade drive axle.

11. The shutter as claimed in claim 10, further comprising a set up jig defining a plurality of spaced apart holes for adjusting said plurality of control bodies relative to said plurality of links, and said plurality of spaced apart holes being located to receive said sleeves to establish a spacing between said plurality of control bodies relative to said plurality of links.

12. A shutter having a plurality of side frames, a plurality of end frames, and a plurality of shutter blades being mounted parallel to one another across said plurality of side frames, the plurality of shutter blades being rotatable between an opened and a closed position, the plurality of end frames being connected to the plurality of side frames, the shutter comprising:

a control recess being formed in one of said plurality of side frames;

a plurality of control bodies being in said control recess, each of said plurality of control bodies being connected to a respective one of the plurality of shutter blades, said plurality of control bodies being located in and rotatable in said control recess to rotate the plurality of shutter blades;

a plurality of links being connected to said plurality of control bodies; and a plurality of fastening devices on said plurality of control bodies, said plurality of fastening devices for adjustably fastening said plurality of control bodies to said plurality of links, whereby to align all of said plurality of control bodies into predetermined rotational positions, said plurality of links communicate rotational movement of any one of the plurality of shutter blades through said plurality of control bodies to all of the plurality of shutter blades for simultaneously rotating all of the plurality of shutter blades into a desired rotational position;

wherein each of the plurality of shutter blades is shaped to fit around an arc, and wherein said plurality of links are adjustable in length and are disposed between each of the plurality of shutter blades.

13. The shutter as claimed in claim 12, wherein said plurality of links comprise a plurality of flexible wire cables.

14. The shutter as claimed in claim 12, wherein said plurality of links comprise a first link portion being rotatably secured to one of the plurality of shutter blades, and a second link portion being rotatably secured to an adjacent shutter blade of the plurality of shutter blades, and an adjustment device for securing together said first link portion and said second link portion.

15. A shutter having a side frames and end frames and a plurality of shutter blades mounted parallel to one another across said side frames, the blades being rotatable between open and closed positions, and comprising;

a control recess formed in one of said side frames;

control bodies within said control recess connected to respective said shutter blades, said control bodies being located in and rotatable within said control recess to rotate respective said blades;

said control bodies each defining a respective rotation axis;

two fastening devices on each said control body, said fastening devices being spaced on opposite sides of said rotation axis, and, two elongated rigid link members registering with respective said fastening devices, and being adjustably secured thereto, for adjustably fastening respective said control bodies to respective said link members, whereby to align all said control bodies into predetermined rotational positions, said link members communicating rotational movement of any one said blade through said control bodies to all said blades so as to procure simultaneous rotation of all said blades into a desired rotational position.

16. A shutter having a side frames and end frames and a plurality of shutter blades mounted parallel to one another across said side frames, the blades being rotatable between open and closed positions, and comprising;

a control recess formed in one of said side frames;

a drive axle for each said blade, said drive axles extending from said blades into said control recess, and said drive axles defining non-rotatable keying surfaces;

control bodies within said control recess connected to respective said shutter blades, said control bodies being located in and rotatable within said control recess to rotate respective said blades, said control bodies each defining a respective rotation axis;

non-rotatable keying recesses in said control bodies shaped to non-rotatably receive respective said blade drive axles therein;

two fastening devices on each said control body, said fastening devices being spaced on opposite sides of said rotation axis, and, two elongated rigid link members registering with respective said fastening devices, and being adjustably secured thereto, for adjustably fastening respective said control bodies to respective said link members, whereby to align all said control bodies into predetermined rotational positions, said link members communicating rotational movement of any one said blade through said control bodies to all said blades so as to procure simultaneous rotation of all said blades into a desired rotational position.

* * * * *